US010082305B2

(12) United States Patent
Oh

(10) Patent No.: US 10,082,305 B2
(45) Date of Patent: Sep. 25, 2018

(54) VENTILATION MODULE WITH SWIRLER FAN

(71) Applicant: TORNADO SYSTEMS CO., LTD., Seongnam (KR)

(72) Inventor: Hee Bum Oh, Yongin (KR)

(73) Assignee: TORNADO SYSTEMS CO., LTD., Seongnam (KR)

( * ) Notice: Subject to any disclaimer, the term of this patent is extended or adjusted under 35 U.S.C. 154(b) by 584 days.

(21) Appl. No.: 14/596,319

(22) Filed: Jan. 14, 2015

(65) Prior Publication Data

US 2016/0161133 A1 Jun. 9, 2016

(30) Foreign Application Priority Data

Dec. 8, 2014 (KR) ..... 10-2014-0175073

(51) Int. Cl.

| | |
|---|---|
| ***F04D 29/28*** | (2006.01) |
| ***F24F 7/06*** | (2006.01) |
| ***F04D 25/16*** | (2006.01) |
| ***F24F 13/06*** | (2006.01) |
| ***F04D 19/00*** | (2006.01) |

(Continued)

(52) U.S. Cl.

CPC ..... *F24F 7/065* (2013.01); *F04D 19/002* (2013.01); *F04D 25/166* (2013.01); *F04D 29/281* (2013.01); *F04D 29/282* (2013.01); *F24F 13/06* (2013.01); *F04D 17/16* (2013.01); *F04D 17/164* (2013.01); *F04D 25/08* (2013.01); *F04D 29/283* (2013.01); *F24F 2221/14* (2013.01)

(58) Field of Classification Search

CPC .... F04D 25/166; F04D 29/281; F04D 29/282; F04D 29/283; F04D 17/16; F04D 17/164; F04D 29/4213; F04D 19/007

See application file for complete search history.

(56) References Cited

U.S. PATENT DOCUMENTS 3,009,409 A * 11/1961 Weaver ..... F04D 25/166 454/208

3,403,614 A 10/1968 Carnes (Continued)

FOREIGN PATENT DOCUMENTS

EP 1355064 A1 * 10/2003 ..... F04D 25/166

EP 1475474 A1 * 11/2004 ..... D06F 58/24

(Continued)

OTHER PUBLICATIONS

WO2013162318A1—Translation by Google Patents.*

(Continued)

*Primary Examiner* — Justin Seabe

*Assistant Examiner* — Behnoush Haghighian

(74) *Attorney, Agent, or Firm* — The PL Law Group, PLLC

(57) ABSTRACT

The disclosure aims to provide a ventilator module with improved efficiency. The ventilator module employs the dual structure of fans includes a swirler fan and a suction fan, in which the swirler fan is disposed at the front side and the suction fan is disposed at the rear side of the swirler fan so that a swirl formed by the drive of the swirler fan forms a donut-like low pressure zone around an inlet, and a tornado is formed by rotating the donut-like low pressure zone by the drive of the suction fan thereby cause the air below swirler fan to ascend at high velocity so as to be suctioned and discharged.

10 Claims, 8 Drawing Sheets

(51) Int. Cl.
*F04D 25/08* (2006.01)
*F04D 17/16* (2006.01)

(56) References Cited

U.S. PATENT DOCUMENTS

| | | | | |
|---|---|---|---|---|
| 3,559,560 | A | 2/1971 | Trahan | |
| 4,020,752 | A | 5/1977 | Stephan | |
| D325,434 | S | 4/1992 | Dosmann | |
| 5,403,163 | A * | 4/1995 | Murphy | F16M 1/00 248/638 |
| 5,807,171 | A | 9/1998 | Felsen | |
| 5,855,469 | A * | 1/1999 | McConnell | F01D 11/10 415/171.1 |
| 6,135,878 | A | 10/2000 | Felsen | |
| 6,648,065 | B2 * | 11/2003 | Huang | F04D 29/582 165/121 |
| 6,935,571 | B2 | 8/2005 | Van Der Merwe | |
| D521,631 | S | 5/2006 | Mladenhabensus | |
| 7,192,254 | B2 * | 3/2007 | Li | F04D 29/282 415/199.1 |
| 7,354,244 | B2 * | 4/2008 | Hasbargen | F23L 17/005 415/212.1 |
| 7,645,188 | B1 | 1/2010 | Peerbolt | |
| 9,115,721 | B2 * | 8/2015 | Xu | F04D 17/025 |
| 2006/0263210 | A1 * | 11/2006 | Wang | F04D 25/166 415/206 |
| 2014/0056703 | A1 * | 2/2014 | Vaughn | F01P 11/12 415/213.1 |
| 2014/0308118 | A1 * | 10/2014 | Lin | F04D 17/16 415/203 |

FOREIGN PATENT DOCUMENTS

| | | | | |
|---|---|---|---|---|
| EP | 2058525 | A1 * | 5/2009 | F04D 29/281 |
| EP | 2980304 | A4 * | 9/2016 | D06F 58/20 |
| JP | 48-84713 | A | 11/1973 | |
| JP | 62-078395 | U | 5/1987 | |
| JP | 2014-47750 | A | 3/2014 | |
| JP | 2014-139412 | A | 7/2014 | |
| KR | 10-0589607 | B1 | 6/2006 | |
| KR | 10-0684696 | B1 | 2/2007 | |
| KR | 10-2011-0020157 | A | 3/2011 | |
| KR | 10-2013-0043413 | A | 4/2013 | |
| KR | 10-1259586 | B1 | 4/2013 | |
| KR | 10-2013-0090048 | A | 8/2013 | |
| KR | 10-1294324 | B1 | 8/2013 | |
| KR | 10-1387016 | B1 | 4/2014 | |
| KR | 10-1463455 | B1 | 11/2014 | |
| KR | 10-2016-0040832 | A | 4/2016 | |
| WO | 2008/114906 | A1 | 9/2008 | |
| WO | WO 2013162318 | A1 * | 10/2013 | F04D 25/088 |
| WO | WO 2015-034274 | A1 | 3/2015 | |
| WO | WO 2015-060509 | A1 | 4/2015 | |

OTHER PUBLICATIONS

Office action dated Mar. 22, 2016 from Japan Intellectual Property Office in a counterpart Japanese Patent Application No. 2015-029886 (all the cited references are listed in this IDS.).

* cited by examiner

VENTILATION MODULE WITH SWIRLER FAN

The present application claims priority from Korean Patent Application No. 2014-0175073, filed on Dec. 8, 2014, which is hereby incorporated by reference for all purposes as if fully set forth herein.

BACKGROUND

1. Field

The disclosure relates to a ventilation system, more particularly to a ventilation apparatus employing a swirler fan formed with plural fins on an annular disk with the opening at the center portion to improve efficiency.

2. Description of Related Art

Air moves from high atmospheric pressure region to low atmospheric pressure region. The mechanical fans are utilizing this aerodynamic principle. Rotating blades pushes air outwards and thereby the atmospheric pressures around the blades are lowered. Then air in surroundings in relatively high atmospheric pressure moves toward the blades. By the directions of blades' distortion, air is suctioned or discharged.

A ventilation fan is used to eliminate contaminants (gases, dusts or particles) in a certain space. A range hood for kitchen made of a ventilation fan is used to discharge pollutants and food odors generated during cooking to the outside by driving a fan so as to prevent them to be dispersed to other space. And a portable dust collector or a portable welding fume extractor made of a ventilation fan is used to eliminate dusts, oil mist, fume, etc. generated in local work places.

In general, a ventilation fan is configured to install pipes in the walls or on the ceilings and to dispose an exhaust vent to the outside, and further, to install an exhaust fan adjacent to an exhaust vent, disposed at the front side of the pipe or the rear side of the pipe. Here, a centrifugal fan (a sirocco fan or a turbo fan) is most commonly used for the exhaust fan to be installed, and infrequently, an axial propeller fan is used.

A ventilation fan is based on the assumption that a fan generates the negative pressures and makes airflow movements toward an exhaust inlet, then contaminants in the space will be carried out with the air exhausted. However, to carry out contaminants to the exhaust in the presence of distributing side flows, gravitational settling, and inertial breakaways of contaminants themselves, the fan has to generate high enough air velocity at the position in which contaminants exist. It is the capture velocity. The minimum capture velocity in quiet air is 50 fpm (0.25 m/s) according to "ACGIH Industrial ventilation: A manual of recommended Practice, 23$^{rd}$ edition". It means that in case the air velocity generated by a ventilation fan is lower than the minimum capture velocity, the contaminants can't be carried out with the air but just light air are exhausted.

Such a ventilation fan of the related art is disadvantageous in that the capture region of contaminants is only defined at the part adjacent to an inlet as illustrated in the diagram of simulation of FIG. 1. That is, when using the exhaust fan configured in a manner such that a plurality of projected blades are arranged at a predetermined interval on a cylindrical body, the air velocity suctioned rapidly decreases inversely proportional to the square of a distance from the entrance of the exhaust vent. Due to such a property, the suction power rapidly drops unless the exhaust fan is installed to be adjacent to a source to generate contaminants.

As illustrated in FIG. 2 (velocity Contours—plain circular opening—% of opening velocity; American Conference of Governmental Industrial Hygienists (ACGIH): Industrial Ventilation Manual, 23rd Edition), this is because that, although the rotation of a typical exhaust fan generates an ascending air current, the velocity of the air current at a position dropped as much as the diameter of the entrance of the exhaust vent is reduced to about 7.4% of the air velocity at the entrance of the exhaust vent.

Such a phenomenon that the velocity is reduced inversely proportional to the square of a distance from the entrance of the exhaust vent is well-known as Dalle Valle equation. Dalla Valle Equation is, $$Vx = \frac{Vf}{12.7 \times \left(\frac{x}{d}\right)^2 + 0.75}$$

Where Vx is velocity at x

Vf is a face velocity at the exhaust inlet x is a distance from the exhaust inlet d is a diameter of exhaust inlet.

For the velocity x=1d $$Vx = \frac{Vf}{12.7 \times \left(\frac{1}{1}\right)^2 + 0.75} = \frac{Vf}{13.45} = 0.074\ Vf,$$

Consequently, the velocity at x=1d, decreases to 7.4% of the face velocity at the exhaust inlet.

Regardless of such a mechanism, in the configuration of the ventilation fan, the exhaust vent is positioned at a point away from the contaminant's source farther than the diameter of the entrance of the exhaust vent so that the discharge power thereof is extremely low. Accordingly, all the existing exhaust apparatuses including a range hood attempt to increase the discharge power by increasing exhaust air volume to raise the air velocity.

However, according to Fan Affinity Law, in order to double the air velocity, it is necessary to increase the power consumption of a fan by $2^3$, that is, eight times (cubic law of air velocity), which is problematic because the power consumption becomes too great and accordingly, the noise thus caused increases.

Power consumption of centrifugal fan by Fan Affinity Law is, $$P_1/P_2=(n_1/n_2)^3(d_1/d_2)^5, q_1/q_2=(n_1/n_2)(d_1/d_2)^3$$

where

P=power (W, bhp, . . . )

q=volume flow capacity ($m^3$/s, gpm, cfm, . . . )

n=wheel velocity—revolution per minute—(rpm)

d=wheel diameter

SUMMARY

Accordingly, the object of the disclosure is to provide a ventilator module of a new scheme capable of improving discharge power while reducing both power consumption and noise.

According to the object described above, a ventilator module of the disclosure is configured to employ dual structure of fans. The ventilator module includes a swirler fan and a suction fan and the swirler fan formed with plural fins on an annular disk with the opening at the center portion is disposed at the front side and the suction fan is disposed at the rear side of the swirler fan so as to form a donut-like low pressure zone around an inlet by a swirl formed by the drive of the swirler fan so that the air at the lower part, which forms a relatively high pressure zone, ascends at a high velocity, and then, is suctioned to an exhaust vent to be discharged by the drive of the suction fan.

In addition, according to the disclosure the ventilator module configured in a manner such that a bell-mouth that is disposed to surround the swirler fan and is formed as a quadrangular truncated pyramid or a truncated cone with a horizontal end formed at the bottom thereof so as to widen the formation area of the donut-like low pressure zone thereby effectively enlarging the capture region of pollutants.

In other words, according to an aspect of the disclosure, provided is a ventilator module including:

a swirler fan formed with plural fins on an annular disk with the opening at the center portion thereof;

a suction fan disposed at the rear side of the swirler fan;

a motor that is assembled via mounting fixtures to the housing so as to be coupled on the same axis and to simultaneously drive the swirler fan and the suction fan;

a bell-mouth that surrounds the swirler fan and is formed as a truncated pyramid, an elliptical truncated cone or a truncated cone with an opening formed at the top thereof and a horizontal end formed at the bottom thereof; and an suction fan case that accommodates the suction fan therein, in which an opening is provided in the bottom of a part in which the suction fan is accommodated, and of which the top is assembled with an outlet.

In addition, according to an aspect of the disclosure, provided is the ventilator module further includes a suction fan case having an opening at a bottom surface thereof and an outlet assembled with the suction fan case.

In addition, according to an aspect of the disclosure, the swirler fan includes a center which is connected to the axis of the motor, an annular band which surrounds outside of the center, a plurality of connection rods which extends from outer surface of the center to inner surface of the annular band in a radial direction, and a ring-shape main body which surrounds outer surface of the annular band on which a plurality of fins is formed.

In addition, according to an aspect of the disclosure, provided is the ventilator module further includes a grid-like guard below the swirler fan.

In addition, according to an aspect of the disclosure, the swirler fan includes a center which is connected to the axis of the motor, a ring-shape main body which is combined with the center, an annular band which surrounds outside of the ring-shape main body and has a plurality of fins protruded toward outside of the annular band along outer surface of the annular band, and a plurality of connection rods which extends from outer surface of the ring-shape main body to inner surface of the annular band in a radial direction.

In addition, according to an aspect of the disclosure, the swirler fan has auxiliary blades on the connection rods to increase the suction air velocity.

In addition, according to an aspect of the disclosure, provided is the ventilator module, in which the suction fan disposed at the rear side of the swirler fan is configured as an axial propeller fan, and an outlet of a suction fan case is assembled so as to be on the same axis as a point at which the suction fan is disposed.

In addition, according to an aspect of the disclosure, provided is the ventilator module including;

a swirler fan formed with plural fins on an annular disk with the opening at the center portion thereof;

a motor housing with mounting fixtures to accommodate the swirler fan therein.

a motor that is assembled via mounting fixtures to the motor housing so as to drive the swirler fan;

a suction fan disposed separately with distance at the rear side of the swirler fan;

a suction fan case with mounting fixtures to accommodate the suction fan therein.

a motor that is assembled via mounting fixtures to the suction fan case so as to drive the suction fan independently.

According to the disclosure, it is possible to provide a exhaust fan or a range hood or a portable dust collector that exhibits strong suction and discharge power by forming an extremely strong tornado air current due to a dual stage fans of a ventilator module that suctions air at high velocity in the ventilation apparatuses. That is, a swirl generated by a swirler fan forms a donut-like low pressure zone so that the air at the lower part, which forms a relatively high pressure zone, ascends at a high velocity, and the air adjacent to the swirler fan is strongly suctioned and discharged by the drive of the suction fan.

In this aerodynamic mechanism, some portion of inducing air via the opening at the center of the swirler fan can be re-diffused to the direction of circumference due to the air forces pushing outward by the rotation of fins on the annular disk. An annular band with a certain height erected vertically in between the inner side of the planer ring-shape main body and the connection rods to the center does a role of preventing inducing air via the opening at the center of the swirler fan from re-diffusing to the direction of circumference, and exhausting efficiently to the outlet.

According to the ventilator module of the disclosure, compared to a ventilation fan by a sirocco fan of the related art, it is possible to exhibit the suction and discharge power over the greater wide range of area, and to eliminate pollutants and odors speedily due to the high velocity of the ascending air current.

In addition, a bell-mouth according to the disclosure may induce the formation of the donut-like low pressure zone over the more extended range at the periphery of the swirler fan so as to enlarge and maintain the center portion of the tornado air current thereby widening the generation area of the ascending air current.

According to the ventilator module of the disclosure employing the dual structure of fans and the bell-mouth, it is possible to powerfully and speedily discharge pollutants and odors in the space with a relatively low power and little noise because it doesn't need to increase wasteful airflow rate to increase air velocity as the conventional fans of the related art do.

DETAILED DESCRIPTION

Hereinafter, preferred embodiments of the disclosure will be described in detail, with reference to the attached drawings.

Figure 3:
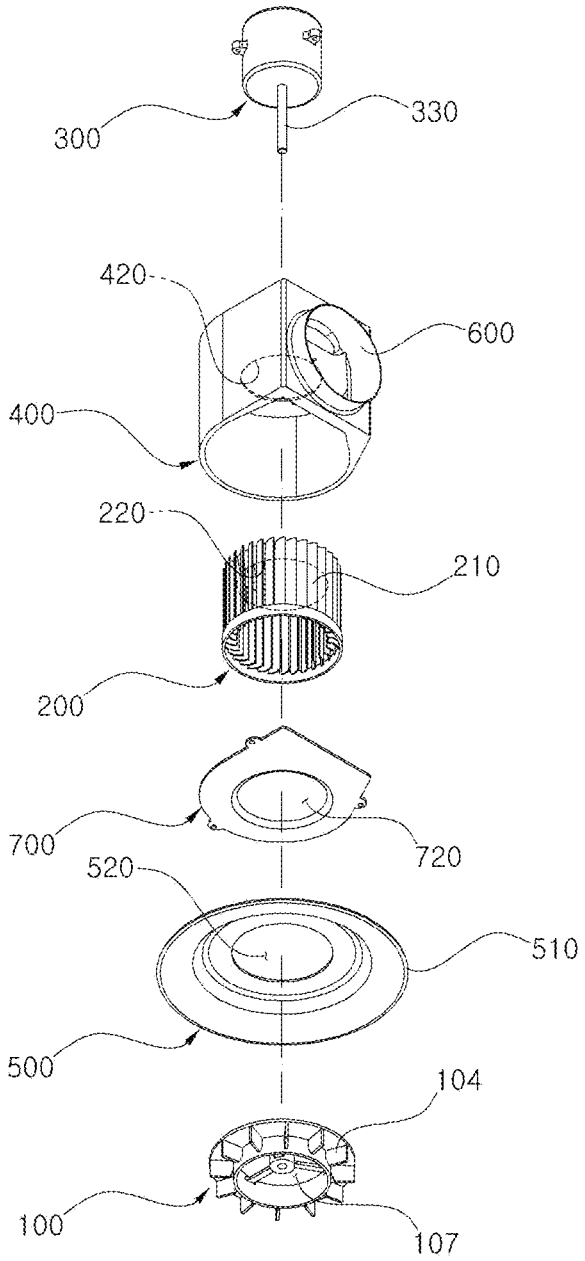
FIG. 3 is an exploded perspective view that illustrates a configuration of a ventilator module according to the disclosure.

FIG. 3 is an exploded perspective view that illustrates a configuration of a ventilator module according to the disclosure.

A ventilator module according to the present exemplary embodiment includes a swirler fan 100, a suction fan 200, and a motor 300. The ventilator module may further include a suction fan case 400, a bell-mouth 500, an outlet 600 and a housing 700.

A swirler fan 100 provided with an opening 107 at the center thereof, and an suction fan 200 arranged at the rear side of the swirler fan 100 are coupled with one motor 300 via coupling members so as to be simultaneously driven. The two fans are assembled to be coupled with the motor 300 being maintained on the same axis which is an axis 330 of the motor.

Figure 4:
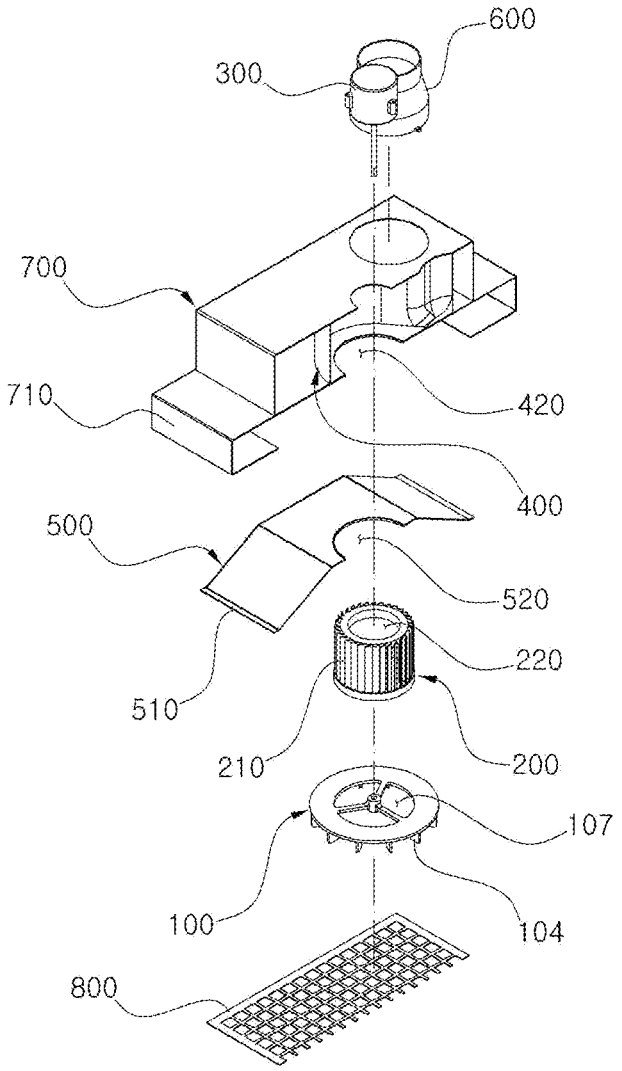
FIG. 4 is a cut exploded perspective view of the range hood configured with the ventilator module according to the disclosure.

FIG. 4 is a cut exploded perspective view of the range hood configured with the ventilator module according to the disclosure.

In general, the range hood is installed on the ceiling of kitchen, and thus, a hood body 710 may be installed on the ceiling so as to serve as a support body for various members to be fixed to the ceiling, and improve the aesthetics. The hood body 710 is provided with an opening at the center thereof. The bell-mouth 500 and the swirler fan 100 are disposed at the front side of the hood body 710. The suction fan case 400 which receives the suction fan 200, and the outlet 600 are disposed in the rear side of the hood body.

In addition, it is desirable to install a grid-like guard 800 below the swirler fan 100.

In this case, the housing 700 having a hexahedron shape to form a space therein may be combined with the rear side of the hood body 710. The suction fan case 400 is received in the space of the housing 700, and the motor 300 and the outlet 600 are disposed at a rear side of the housing 700 to be connected to the suction fan case 400.

Figure 5:
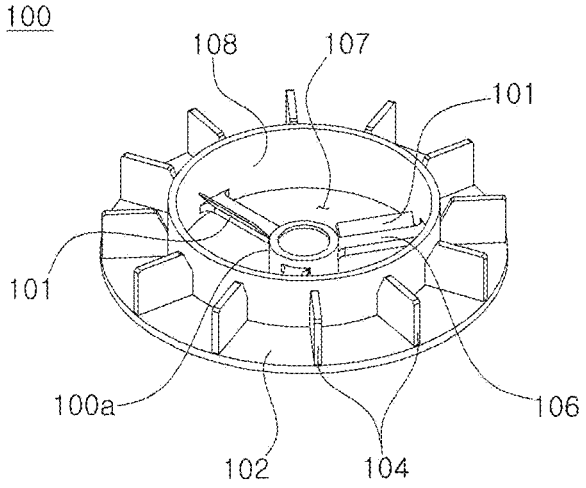
FIG. 5 is a perspective view of the swirler fan according to the disclosure.

FIG. 5 is a perspective view of the swirler fan according to the disclosure.

The swirler fan 100 is configured such that a plurality of fins 104 are arranged toward the bottom of a main body at the lower side of the planer ring-shape main body 102 having an opened center portion, and a central opening 107 is provided with connection rods 106 to form a connection so that a shaft of the motor 300 is connected to the center, and an annular band 108 with a certain height is erected vertically in between the inner side of the planer ring-shape main body 102 and the connection rods 106 to the center 100*a* thereof.

Thus, the swirler fan 100 of FIG. 5 includes a center 100*a* which is connected to the axis 330 of the motor 300, an annular band 108 which surrounds outside of the center 100*a*, a plurality of connection rods 106 which extends from outer surface of the center 100*a* to inner surface of the annular band 108 in a radial direction, and a ring-shape main body 102 which surrounds outer surface of the annular band 108 on which a plurality of fins 104 is formed.

In this case, an auxiliary blade 101 with a predetermined slant angle may be formed at a side of the connection rod 106. The auxiliary blade 101 may increase flow speed through the opening 107 when the ring-shape main body 102 rotates.

Figure 6:
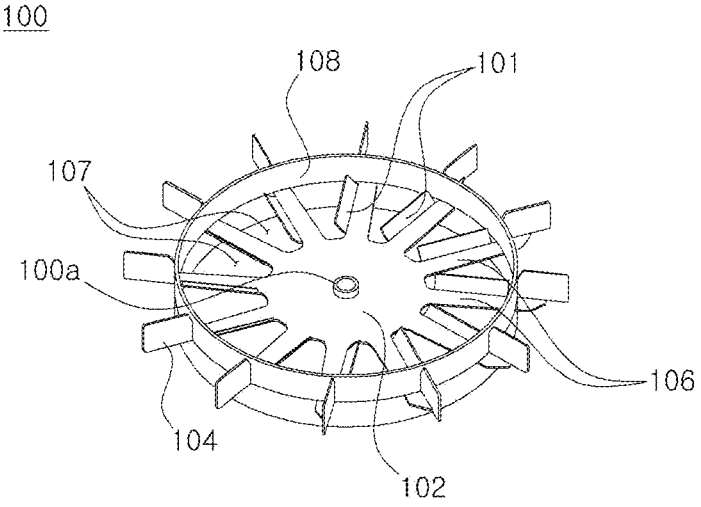
FIG. 6 is a perspective view that illustrates another example of the swirler fan according to the disclosure.

FIG. 6 is a perspective view that illustrates another example of the swirler fan according to the disclosure.

the swirler fan 100 is configured such that a plurality of connection rods 106 are arranged from the center, and an annular band 108 with a certain height is erected at the end of the connection rods 106, and a plurality of fins 104 are formed at the outer side of the annular band 108 thereof.

Thus, the swirler fan 100 of FIG. 5 includes a center 100*a* which is connected to the axis 330 of the motor 300, a ring-shape main body 102 which is combined with the center 100*a*, an annular band 108 which surrounds outside of the ring-shape main body 102 and has a plurality of fins protruded toward outside of the annular band 108 along outer surface of the annular band 108, and a plurality of connection rods 106 which extends from outer surface of the ring-shape main body 102 to inner surface of the annular band 108 in a radial direction.

In addition, an auxiliary blade 101 with a predetermined slant angle may be formed at a side of the connection rod 106. The auxiliary blade 101 may increase suction air velocity through the opening 107 when the ring-shape main body 102 rotates.

In addition, according to another example embodiment of the disclosure, an end of a connection rod 106 may penetrate an annular band 108 to be protruded toward outside, and a fin 104 may be formed on the end of the connection rod 106 in a perpendicular direction. In another example embodiment, the fin 104 may include a horizontal element which is formed on outer surface of the annular band 108 in parallel with the ring-shape main body 102, and a vertical element which is formed at an end of the horizontal element in perpendicular direction.

Figure 10:
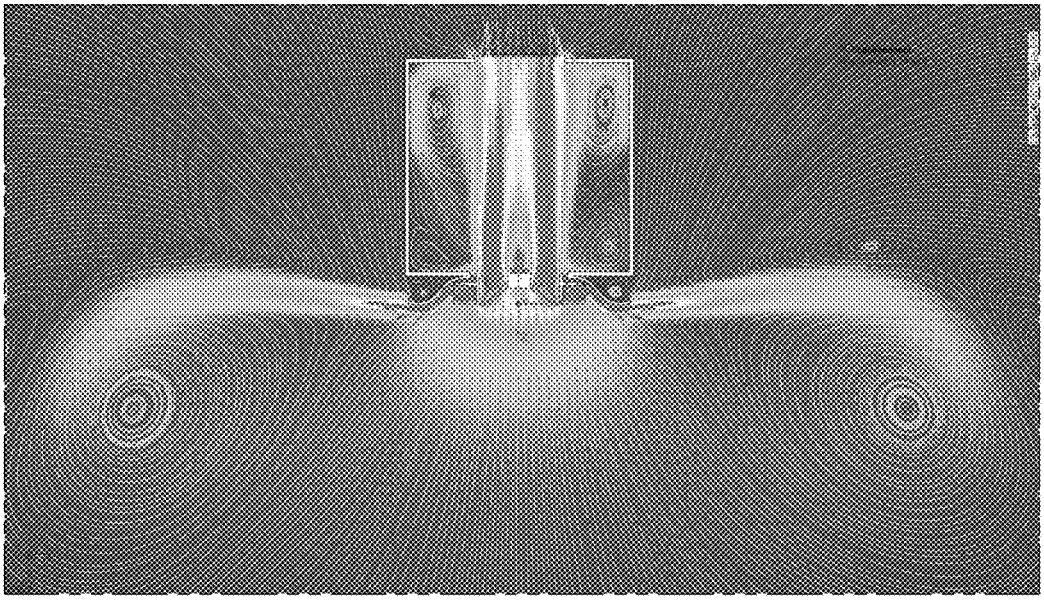
FIG. 10 is a diagram that illustrates the result of simulation of air current and pressure contours formed by the ventilator module according to the disclosure.
Figure 11:
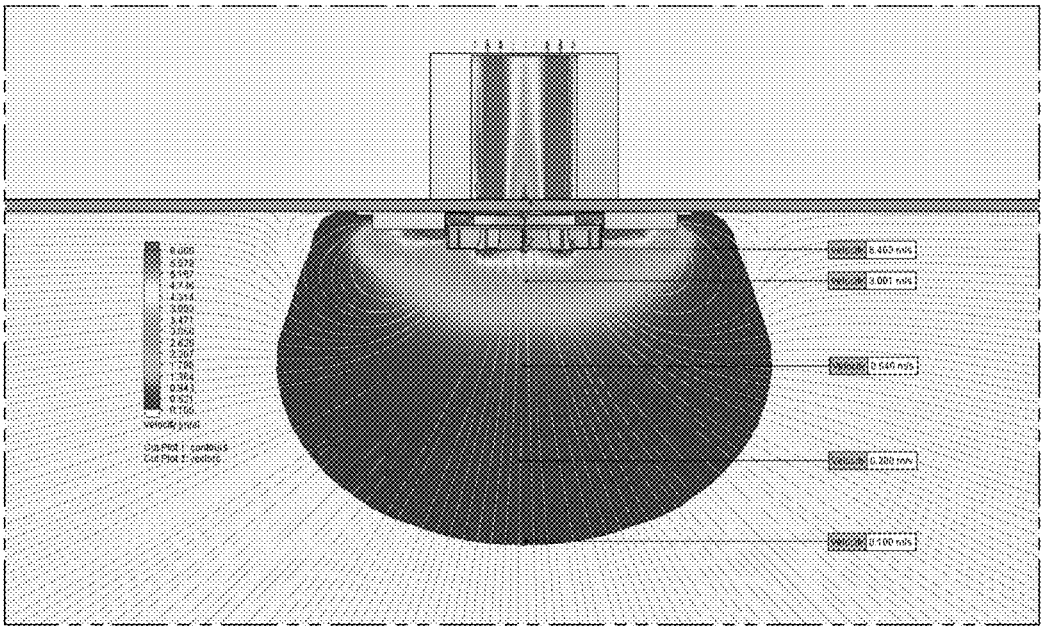
FIG. 11 is a diagram that illustrates the capture region by the result of simulation of air current and velocity contours formed by the ventilator module according to the disclosure.

The swirler fan 100 is rotated by the motor 300 to form a swirl. The swirl forms, as illustrated in FIGS. 10 and 11, a donut-like low pressure zone. FIGS. 10 and 11 are exemplary cross-sectional views. When the swirler fan 100 is driven, the air current flows toward the outer side of the swirler fan 100 and then flows back toward the center of the swirler fan 100 thereby forming a low pressure trough. That is, a donut-like (viewed in three dimensions) low pressure zone is formed at the outer side periphery of the swirler fan 100. Due to the low pressure zone, low pressure is also formed around the center portion of the swirler fan 100 so that an ascending air current is generated for a while.

However, only with the low pressure formed at the center portion by the swirler fan 100, it is difficult to obtain a desired level of effect in air suction and discharge. Therefore, according to the disclosure, the suction fan 200 is additionally provided at the rear side of the swirler fan 100 and driven so as to generate a stronger ascending air current. When the suction fan 200 and the swirler fan 100 are driven to rotate together, the donut-like low pressure zone takes a circular motion to form a tornado air current that allows a wide range of collection of air. A significantly strong level of low pressure zone is formed at the center portion of the tornado air current so that the air current ascend at high speed by receiving rising propulsion supplied by the suction fan 200. With such a mechanism, the ventilator module according to the disclosure can exhibit powerful and speedy discharge effect of pollutants and odors.

The swirler fan 100 and the suction fan 200 are assembled on the same axis, and the one motor 300 is coupled thereto at the axis so as to drive the swirler fan 100 and the suction fan 200 simultaneously.

The bell-mouth 500 having an opening 520 at an upper portion thereof and an inclined surface which is inclined toward outside and bottom direction along boundaries of the upper portion, as illustrated in FIG. 3, FIG. 4, is provided with a horizontal end 510, expanded in horizontal, at an end of the inclined surface of the bell-mouth 500 which is the bottom of the bell-mouth 500. With such a horizontal end 510, as can be seen from the simulation of FIG. 10, the air current generated by the drive of the swirler fan 100 forms a swirl along the horizontal end 510 thereby enlarging the size of the swirl according to Coanda Effect, which is the tendency of a fluid jet to be attracted to a nearby surface, and as a result, the collection area increases.

In other words, as the air current flows along an inclined surface of the bell-mouth 500 and the horizontal end 510, the travel distance of the air current is extended so that the air current flows back rather than receives a constant propulsion thereby forming the donut-like low pressure zone. It is satisfactory that such a bell-mouth 500 has the inclined surface and the horizontal end 510, and thus, the shape thereof is not necessarily the quadrangular truncated pyramid. When the bell-mouth 500 is formed as a truncated pyramid, an elliptical truncated cone or a truncated cone and the bottom thereof is provided with the horizontal end 510, it is possible to exhibit the same function. In case of the quadrangular truncated pyramid shape, the horizontal end 510 is provided only at an edge in the lateral direction to simplify the configuration.

The bell-mouth 500 also has an opening 520 at the center portion. With the opening 520, it is possible to increase the flow rate of ascending air current at the center portion and to extend the collection range.

When the donut-like low pressure zone is formed according to the configuration of the swirler fan 100 and the bell-mouth 500, it is necessary to apply a driving force to rotate the low pressure zone to form a tornado air current so that a strong ascending air current is formed at the center thereof, which is served by the suction fan 200. As the suction fan 200, a conventionally well-known centrifugal fan (a sirocco fan or a turbo fan) or an axial fan may be applied, and also as a suction fan case 400, a conventionally well-known case is used. The suction fan is a cylinder with an opening 220 at the center thereof and has a plurality of blades 210. The suction fan case 400 as described in FIG. 3 includes a part in which the suction fan 200 is accommodated and a part into which an outlet 600 is assembled, which are configured to be eccentric to each other. In the bottom of the suction fan case 400, an opening 420 is provided at the part in which the suction fan 200 is accommodated, and in the top of the suction fan case 400, an opening is provided at the part into which the outlet 600 is assembled. Other than the suction fan case 400, a housing 700 that accommodates the suction fan case 400 therein may be further applied, and accordingly, the top of the suction fan case 400 may be completely opened. In this case, the top of the suction fan case 400 is assembled to the housing 700, the suction fan case 400 is accommodated in the housing 700 in a manner such that the housing 700 completely seals the air current. This embodiment adopts such a configuration as illustrated in the drawings.

Figure 7:
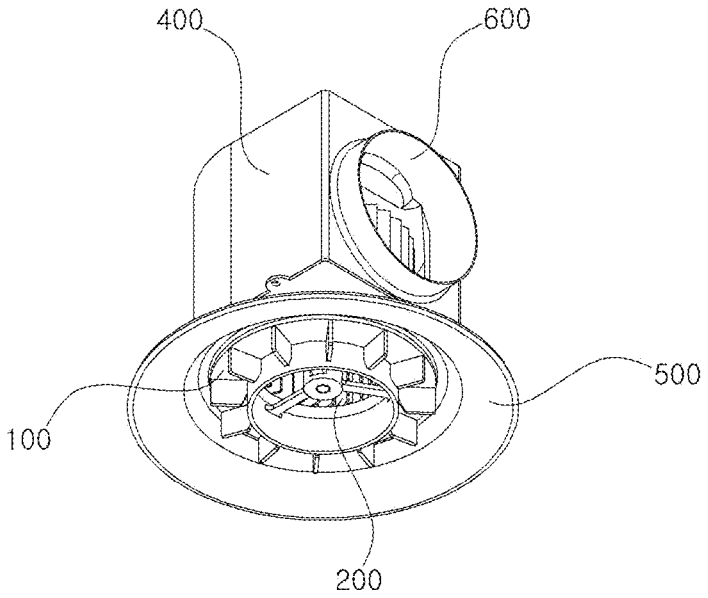
FIG. 7 is a perspective view that illustrates an assembly of the ventilator module according to the disclosure.

FIG. 7 is a perspective view that illustrates an assembly of the ventilator module according to the disclosure.

The motor 300 is combined with a rear end of the suction fan case 400. The suction fan 200 is received in the suction fan case 400. The housing 700 and the bell-mouth 500 are combined with a front end of the suction fan case 400 in order. The axis 330 of the motor 300 penetrates the opening 420 of the suction fan case 400, the suction fan 200, the opening 720 of the housing 700, and the opening 520 of the bell-mouth 500, so that the axis 330 is combined with the center 100*a* of the swirler fan 100. The outlet 600 is formed toward outside of the suction fan 200 in a radial direction.

Figure 8:
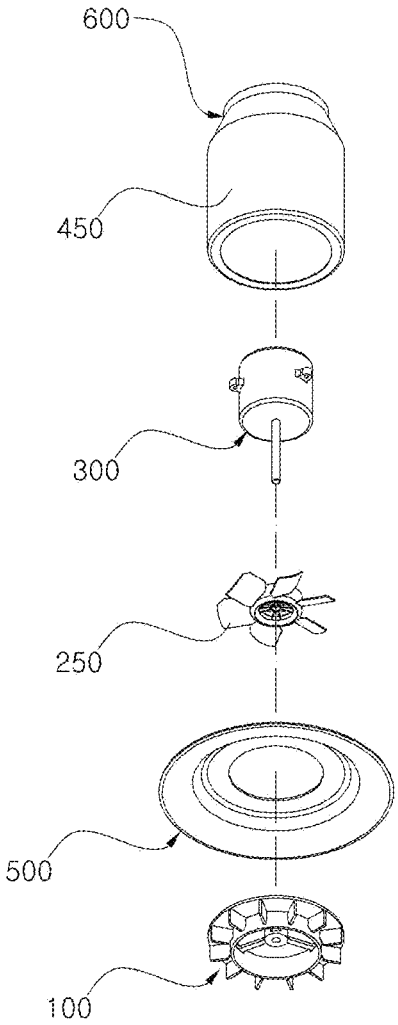
FIG. 8 is an exploded perspective view that illustrates another example of the ventilator module according to the disclosure.

FIG. 8 is an exploded perspective view that illustrates another example of the ventilator module according to the disclosure.

In addition, as shown on FIG. 8, in a case in which the suction fan, installed at the rear side of the swirler fan 100 with the opening at the center thereof, is configured as an axial propeller fan 250, the outlet of the suction fan case may be assembled to be positioned on the same axis as a point at which the suction fan is disposed. As shown on FIG. 8, the outlet 600 may be assembled to the suction fan case or the housing 450. An opening may be formed at a central portion of the axial propeller fan 250 and between wing frames, so that air flow may be formed therethrough. According to the axial propeller fan 250 of FIG. 8, structure of the ventilator module may be simplified. A motor 300 and the axial propeller fan 250 may be received in the suction fan case 450, and a bell-mouth 500 and the swirler fan 100 may be disposed at a front end of the suction fan case 450.

Figure 9:
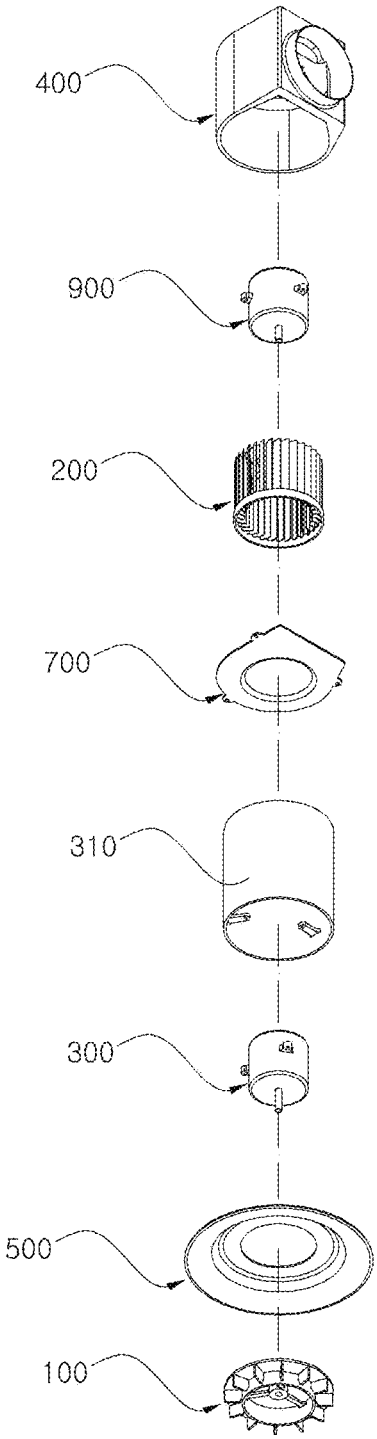
FIG. 9 is an exploded perspective view that illustrates another configuration of a ventilator module according to the disclosure.

FIG. 9 is an exploded perspective view that illustrates another configuration of a ventilator module according to the disclosure.

In cases that the ventilator module according to the disclosure is applied in portable ventilation equipments such as a portable dust collector, a portable welding fume extractor, etc., it is necessary to install filters at the of the outlet to eliminate or trap pollutants. In such cases the suction forces of the suction fan 200 in the ventilator module could be decreased due to the pressure drop by filters. To overcome this problem it is necessary to drive the suction fan 200 at the rear portion with stronger rotational power.

For this application FIG. 9 illustrates another configuration of a ventilator module according to the disclosure comprising a motor 300 with a motor housing 310 to drive a swirler fan 100, and another motor 900 with a suction fan case 400 disposed separately with distance to drive a suction fan 200 independently.

FIG. 10 is a diagram that illustrates the result of simulation of air current and pressure contours formed by the ventilator module according to the disclosure.

The air current flows along an inclined surface of the bell-mouth 500 and the horizontal end 510, and flows back forming the donut-like low pressure zone. A significantly strong level of low pressure zone is formed at the center portion of the tornado air current so that the air current ascends at high speed by receiving rising propulsion supplied by the suction fan 200. In addition, FIG. 10 shows that the bell-mouth 500 enlarges the capture regions.

FIG. 11 is a diagram that illustrates the capture region by the result of simulation of air current and velocity contours formed by the ventilator module according to the disclosure.

Figure 1:
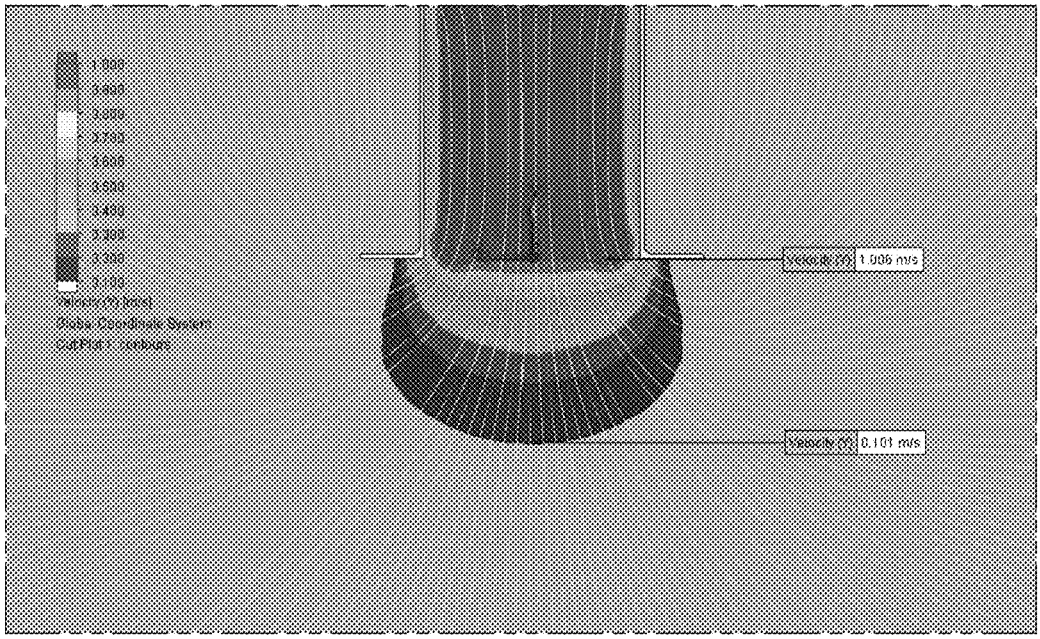
FIG. 1 is a diagram that illustrates the result of simulation of air current and pressure contours according to a conventional exhaust apparatus of the related art.
Figure 2:
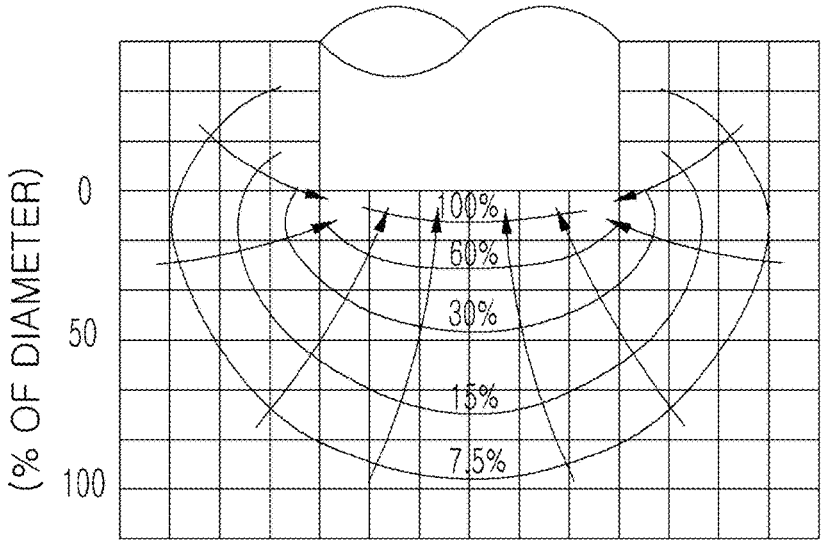
FIG. 2 is a diagram that illustrates velocity contours at an inlet of a typical exhaust vent on "velocity Contours—plain circular opening—% of opening velocity; American Conference of Governmental Industrial Hygienists (ACGIH): Industrial Ventilation Manual, 23rd Edition".

It shows that the ventilator module according to the disclosure creates the wider capture region and the deeper capture depth than the conventional fans' as shown on FIG. 1.

With such a mechanism, the ventilator module according to the disclosure can exhibit powerful and speedy discharge effect of pollutants and odors.

The right of the disclosure is not limited by the embodiment(s) described hereinbefore, but shall be defined according to the description in the scope of claims hereinafter. It is apparent that a person with an ordinary knowledge of the related art to which the disclosure pertains may conduct various alteration or modification within the scope of the right described in the scope of claims.

What is claimed is:

1. A ventilator module comprising:

a swirler fan having a plurality of fins on a ring-shape main body with the opening at the center portion thereof, the swirler fan having a front side in which a flow inlets;

a suction fan disposed at a rear side of the swirler fan;

a motor disposed at the rear side of the swirler fan, the motor coupled to the swirler fan and the suction fan with a same axis, configured to drive the swirler fan and the suction fan; and a bell-mouth that surrounds the swirler fan;

wherein the swirler fan comprises a center which is connected to the axis of the motor, an annular band which surrounds outside of the center, a plurality of connection rods which extends from outer surface of the center to inner surface of the annular band in a radial direction, and the ring-shape main body which surrounds outer surface of the annular band on which the plurality of fins is formed; and the swirler fan has auxiliary blades on the connection rods to increase the suction air velocity.

2. The ventilator module according to claim 1, further comprising a suction fan case having an opening at a bottom surface thereof and an outlet assembled with the suction fan case.

3. The ventilator module according to claim 1, wherein the bell-mouth is formed as a truncated pyramid, an elliptical truncated cone or a truncated cone with an opening formed at the top thereof and a horizontal end surrounding the bottom thereof.

4. The ventilator module according to claim 1, wherein the swirler fan comprises a center which is connected to the axis of the motor, the ring-shape main body which is combined with the center, an annular band which surrounds outside of the ring-shape main body and has the plurality of fins protruded toward outside of the annular band along outer surface of the annular band, and a plurality of connection rods which extends from outer surface of the ring-shape main body to inner surface of the annular band in a radial direction.

5. A ventilator module comprising:

a swirler fan having a plurality of fins on a ring-shape main body with the opening at the center portion thereof;

a suction fan disposed at a rear side of the swirler fan;

a motor coupled to the swirler fan and the suction fan with a same axis, configured to drive the swirler fan and the suction fan;

wherein the swirler fan comprises a center which is connected to the axis of the motor, an annular band which surrounds outside of the center, a plurality of connection rods which extends from outer surface of the center to inner surface of the annular band in a radial direction, and the ring-shape main body which surrounds outer surface of the annular band on which the plurality of fins is formed; and the swirler fan has auxiliary blades on the connection rods to increase the suction air velocity.

6. The ventilator module according to claim 4, wherein the swirler fan has auxiliary blades on the connection rods to increase the suction air velocity.

7. The ventilator module according to claim 1, wherein the suction fan disposed at the rear side of the swirler fan is configured as axial propeller fan, and an outlet of a suction fan case is assembled so as to be on the same axis as a point at which the suction fan is disposed.

8. The ventilator module of claim 1, wherein the motor drives the swirler fan and the suction fan simultaneously.

9. The ventilator module of claim 1, wherein the motor comprises a first motor driving the swirler fan and a second motor driving the suction fan.

10. The ventilator module according to claim 1, wherein the swirler fan has the center portion having a first opening, and a second opening between the center portion and the ring-shape main body.

* * * * *